US006641894B2

(12) United States Patent
Bando

(10) Patent No.: US 6,641,894 B2
(45) Date of Patent: Nov. 4, 2003

(54) STACK OF FOLDED SHEETS

(75) Inventor: Takeshi Bando, Kagawa (JP)

(73) Assignee: Uni-Charm Corporation, Kawanoe (JP)

( * ) Notice: Subject to any disclaimer, the term of this patent is extended or adjusted under 35 U.S.C. 154(b) by 34 days.

(21) Appl. No.: 09/934,956

(22) Filed: Aug. 22, 2001

(65) Prior Publication Data

US 2002/0039638 A1 Apr. 4, 2002

(30) Foreign Application Priority Data

Sep. 18, 2000 (JP) ..... 2000-281408

(51) Int. Cl.[7] ..... B32B 3/04

(52) U.S. Cl. ..... 428/126; 428/130; 206/494; 221/48

(58) Field of Search ..... 428/126, 130; 221/47, 48; 206/494

(56) References Cited

U.S. PATENT DOCUMENTS 1,645,189 A * 10/1927 Ek ..... 206/494

FOREIGN PATENT DOCUMENTS

| | | | |
|---|---|---|---|
| DE | 303791 | 2/1918 | ..... 54/15 |
| EP | 0365462 | 4/1990 | ..... A47K/10/42 |
| EP | 0978247 | 2/2000 | ..... A47K/10/42 |

* cited by examiner

*Primary Examiner*—Alexander S. Thomas
(74) *Attorney, Agent, or Firm*—Darby & Darby

(57) ABSTRACT

Provided is a stack of sheets including a plurality of individually folded sheets which are stacked vertically one on a top of the other via an overlapping portion having a predetermined width so that an underlying sheet is lifted along with an overlying sheet when the overlying sheet is withdrawn. Each sheet is folded about fold lines all parallel to one side of the sheet to define two central portions, a top flap portion folded upward upon one central portion, and a bottom flap portion folded downward under the other central portion. The folded sheets are stacked up so that the odd-numbered sheets and the even-numbered sheets are alternately arranged, and that the top flap portion of the underlying sheet overlies the bottom flap portion of the overlying sheet to define the overlapping portion.

7 Claims, 3 Drawing Sheets

STACK OF FOLDED SHEETS

BACKGROUND OF THE INVENTION

1. Field of the Invention

The present invention relates to a stack of folded sheets of, for example, wet tissues, wet nonwoven fabrics, dry tissues or dry nonwoven fabrics which are vertically arranged so as to facilitate a dispensing of the sheets one at a time.

2. Description of the Related Art

To keep their wet condition, wet sheets for wiping hands or babies' crotches or for cleaning toilets or kitchens are airtightly sealed, for example, in hard containers or in bags made of a wrapping sheet. The containers or bags for such wet sheets are provided with an opening through which the wet sheets packaged therein can be withdrawn one at a time. In such containers or bags, the wet sheets are stacked vertically one on top of the other in an interfolded manner, and therefore, when the upper-most sheet is withdrawn through the opening of a container or bag, the underlying sheet is lifted and drawn to present an upper portion thereof in a readily accessible location above the opening.

FIG. 4 is an illustration of one example of the prior arts of this type, so-called pop-up stack of folded sheets.

As shown in FIG. 4, a plurality of folded sheets 1 are arranged in a stacked configuration. In this, each sheet is arranged in a Z-folded configuration to define a top flap portion 4, a central portion 2 and a bottom flap portion 6. The top flap portion 4 is folded about a fold line 3 upon the central portion 2, and the bottom flap portion 6 is folded about a fold line 5 under the central portion 2.

The thus-folded sheets 1 are stacked vertically one on top of each other in such a manner that the top flap portion 4 of the underlying sheet 1 lies between the central portion 2 and the bottom flap portion 6 of the overlying sheet 1, and that the top-flap portion 4 of the underlying sheet 1 and the bottom flap-portion 6 of the overlying sheet 1 overlap with each other in a predetermined width Lw (this is referred to as an overlapping portion). When the folded sheets are moistened like wet tissues, the adjacent sheets, i.e., the top flap portion 4 of the underlying sheet 1 and the bottom-flap portion 6 of the overlying sheet 1 are kept in airtight contact with each other at an overlapping portion thereof via a water film existing therebetween.

A stack of folded sheets 1 shown in FIG. 4 is packaged in a package 10, for example, a hard container of plastic or a bag of a soft wrapping sheet. The top face of the package 10 is formed with an opening 11 having a predetermined width.

When the upper-most folded sheet 1 of the stack is withdrawn through the opening 11, the underlying sheet is lifted and drawn via the overlapping portion to present of an upper end portion thereof from the opening 11 after the upper-most sheet has been withdrawn, thereby allowing a dispensing of the underlying sheet.

In case of folding each sheet to form a stack of this type, it is necessary to appropriately define the width Lw of overlapping portion of the overlying and underlying sheets. If the width Lw of overlapping portion is too short, the underlying sheet cannot follow the overlying sheet when the overlying sheet is withdrawn, and if so, the underlying sheet will remain in the package 10. On the other hand, if the width Lw of overlapping portion is too long, the amount of the underlying sheet which is pulled through the opening 11 will be increased after the overlying sheet has been withdrawn. As a result, the sheet tends to be dry.

For example, when the sheets are hydrophilic fibers-containing paper sheets or nonwoven fabrics and are moistened with water or solution, the width Lw is preferably 30 mm or so, ranging within 30±20 mm to facilitate a stable dispensing.

With the sheets for wiping hands or babies crotches, the unfolded length L0 of a long side is 190 mm or 200 mm, generally falling between 150 and 230 mm or so. As shown in FIG. 5, the sheets are serially arranged and folded alternately in V and reverse V-configurations via the width Lw of overlapping portion. In the illustrated embodiment of FIG. 5, it is assumed that the width of overlapping portion is 30 mm, and the unfolded length L0 of the long side of the sheet is 200 mm. In that case, the width Ld of each two-folded (V-shaped) sheet is 100 mm, and the width Le of the overlapped sheets is-derived from the equation, 2×Ld−Lw, that is, Le is 170 mm, result in being extremely large. Accordingly, the width of the package that contains the stack of folded sheets will be also increased.

In case where each sheet is arranged in a Z-folded configuration (folded in three) as shown in FIG. 4, the width of the stacked sheets can be reduced.

For example, if the unfolded length L0 of the long side of the sheet shown in FIG. 4 is 200 mm and the width Lw of overlapping portion is 30 mm, the width La of the central portion 2 will be 85 mm. Specifically, in that case where the width La is 85 mm, the sum of the width Lb of the top flap portion 4 and the width Lc of the bottom flap portion 6, i.e., the sum of Lb and Lc is 115 mm (200−85=115), and, in addition, the width Lw of overlapping portion can be set as 30 mm (115−85=30).

Accordingly, the width of the stack of folded sheets shown in FIG. 4 can be reduced to a half of the width thereof of FIG. 5. However, in order to further reduce the width of the package 10 so that such small packages are available for portable applications and can be stored even in narrow spaces, the stack of two-folded sheets as shown in FIG. 5 and the stack of three-folded sheets as shown in FIG. 4 have their limitations for such purposes. Namely, in order that the width Lw of overlapping portion is appropriately defined and the width of the stack is reduced in each stack of two-folded or three-folded sheets, the unfolded length L0 of the long side of the sheets must be short. In other words, it is necessary to downsize the individual sheets.

However, if the unfolded length L0 of the sheet becomes short, it is impossible to ensure a satisfactory sheet area enough for wiping operations to cause any inconvenience for users when the sheets are withdrawn from the package 10 and used for wiping hands or babies' crotches.

SUMMARY OF THE INVENTION

An object of the present invention is to provide a stack of folded sheets in which the width of overlapping portion of the overlying and underlying sheets therein can be appropriately defined, and the width of the stack can be reduced, without downsizing the individual sheets.

According to an aspect of the invention, a stack of sheets comprising a plurality of individually folded sheets which are stacked vertically one on top of the other via an overlapping portion having a predetermined width so that an underlying sheet is lifted along with an overlying sheet when the overlying sheet is withdrawn, wherein each sheet is folded about fold lines all parallel to one side of the sheet to define two central portions having the same width, a top flap portion folded upward upon one central portion, and a bottom flap portion folded downward under the other central portion, and the folded sheets are stacked up so that the odd-numbered sheets and the even-numbered sheets are alternately arranged to orient a first fold line of each odd-numbered sheet in the opposite direction of a first fold line of each even-numbered sheet, and that the top flap portion of the underlying sheet overlies the bottom flap portion of the overlying sheet to define the overlapping portion.

For example, the sheets are moistened with water or solution, and the width Lw of overlapping portion is 30±20 mm, more preferably 30±10 mm.

In the stack of sheets in which the dimensions of each folded sheet are defined to satisfy L2+L3−Lw=L1, if the unfolded length L0 of each sheet is expressed by L0=2× L1+L2+L3, wherein L1 indicates the width of the central portions, L2 indicates the width of the top flap portion, and L3 indicates the width of the bottom flap portion.

Also preferably, the stack of folded sheets is packaged in a hard or soft package having an access opening in the top face thereof to facilitate a dispensing of the sheets one at a time through the access opening.

In the stack of sheets of the invention, each sheet is folded into four i.e., into a W-folded configuration, and the odd-numbered sheets and the even-numbered sheets are alternately arranged in opposite directions. In this, the width dimensions of each four-folded sheet are specifically defined, and as a result, the overall width of the stack can be shortened in comparison with the typical stacks of V-folded or Z-folded sheets, in addition, the width of overlapping portion of the overlying and underlying sheets can be 30±20 mm.

DESCRIPTION OF THE PREFERRED EMBODIMENTS

Figure 1:
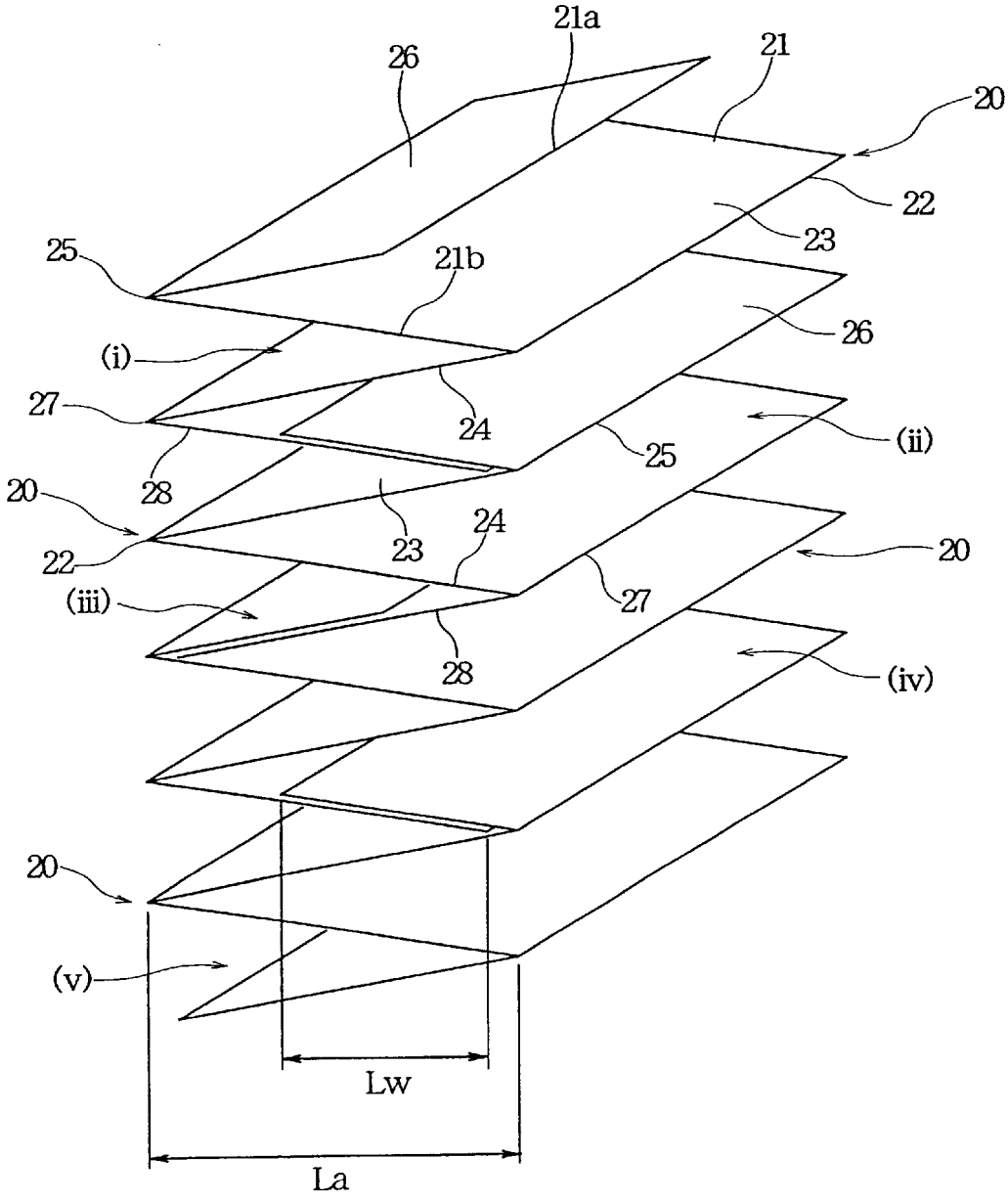
FIG. 1 is a perspective view of one embodiment of a stack of folded sheets according to the invention.
Figure 2:
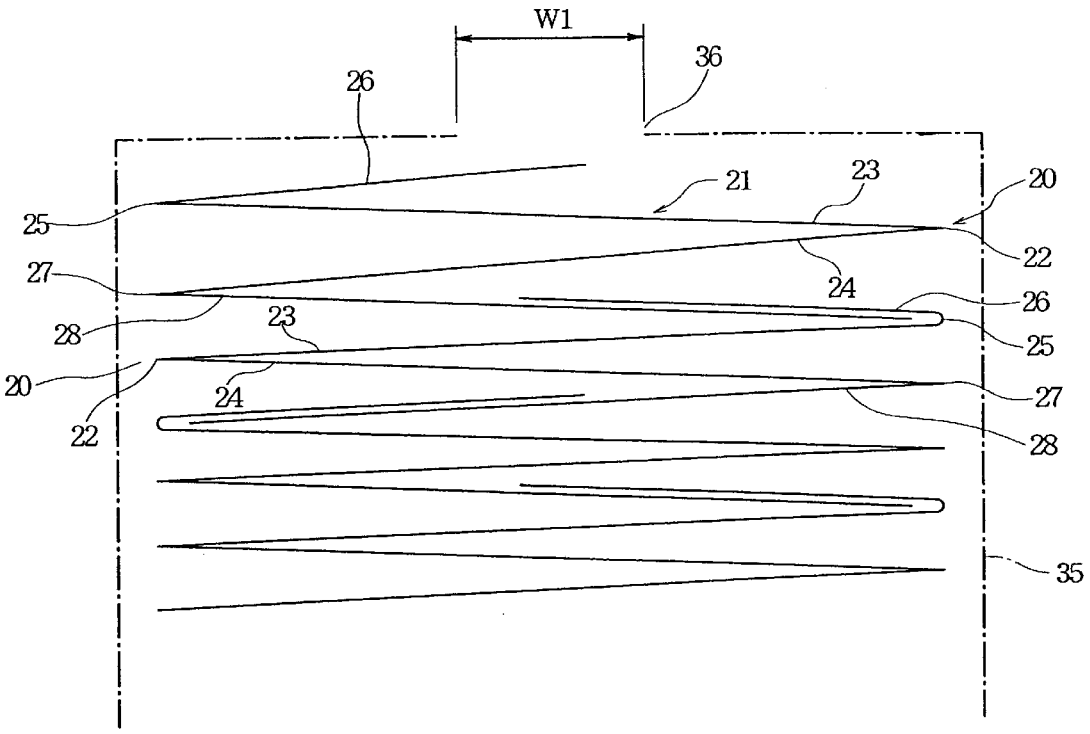
FIG. 2 is a side view showing the stack of folded-sheets packaged in a container.
Figure 3:
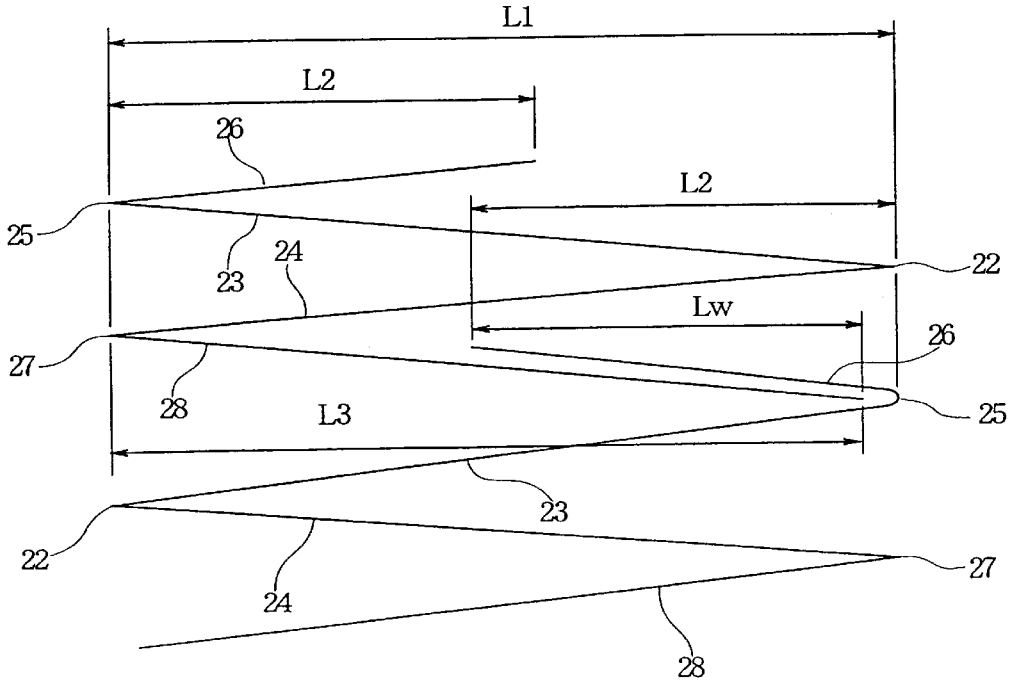
FIG. 3 is a side view illustrating the dimensions of folded sheets in the stack of sheets.
Figure 4:
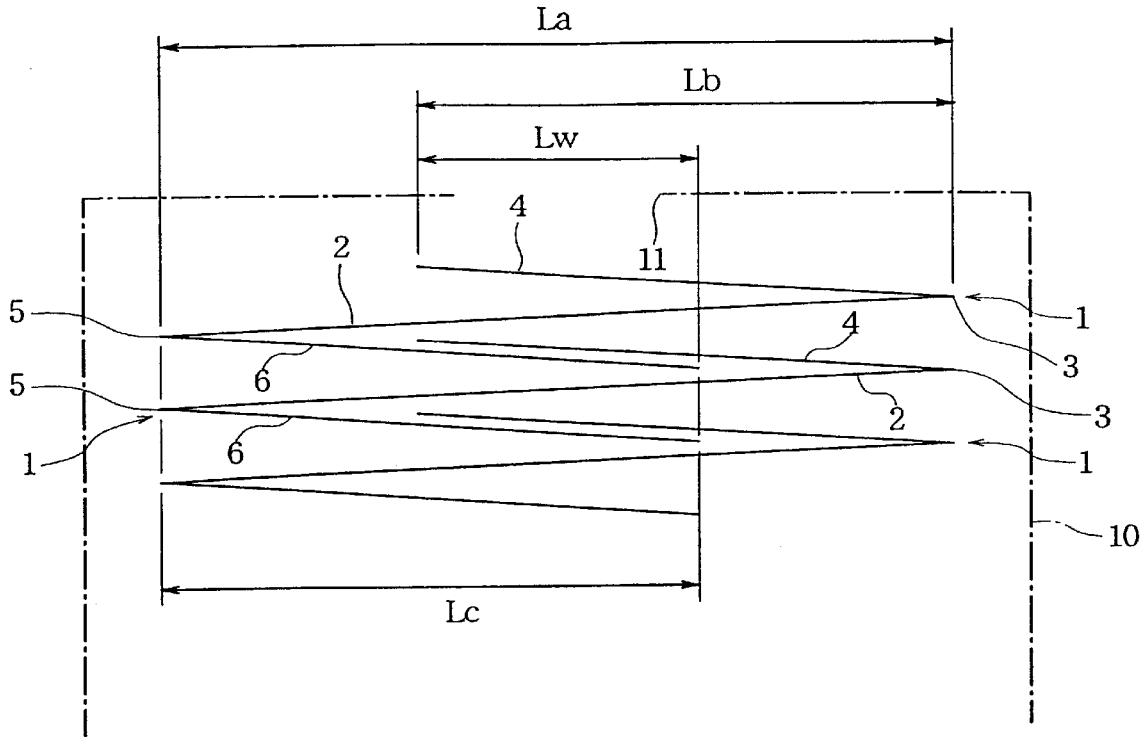
FIG. 4 is a side view showing a conventional stack of Z-folded sheets.
Figure 5:
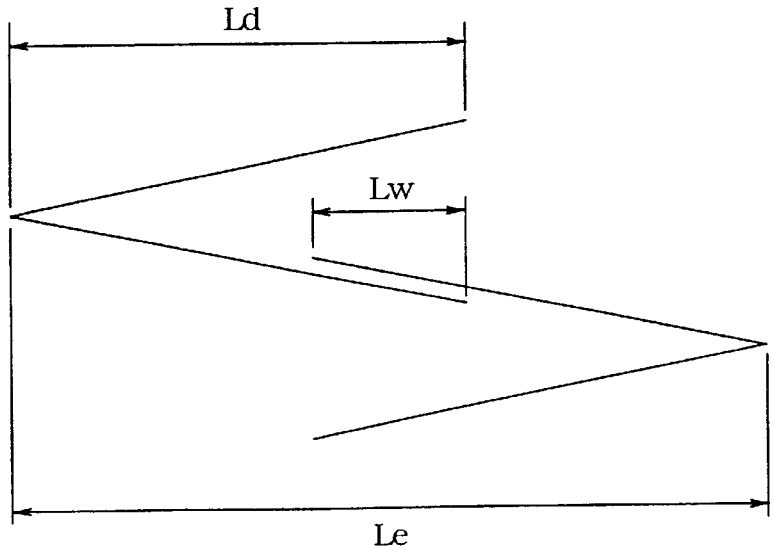
FIG. 5 is a side view showing another conventional stack of V-folded sheets.

The invention will be described concretely with reference to the accompanying drawings. FIG. 1 is a perspective view of one embodiment of a stack of folded sheets of the invention. FIG. 2 is a side view showing the stack of folded sheets packaged in a container. FIG. 3 is a side view illustrating the dimensions of folded sheets in the stack of folded sheets.

As shown in FIG. 1, a plurality of folded sheets 20 are serially arranged and folded alternately in W and reverse W-configurations to form a stack of folded sheets. Specifically, the odd-numbered sheets (i), (iii), (v) . . . and the even-numbered sheets (ii), (iv) . . . are alternately arranged in opposite directions.

Sheets 21 to be folded may be paper or nonwoven fabrics. For example, they are sheets of water-undegradable paper of pulp that contains a binder, or are sheets of nonwoven fabrics such as spun lace made of regenerated cellulose fibers or of regenerated cellulose fibers and synthetic resin fibers.

The sheets 21 may also be water-degradable sheets of which the fibers are broken and dispersed in water when they are, after used, disposed of in flush toilets and have received a large amount of water therein. For example, they include paper or nonwoven fabrics made of fibers such as rayon or pulp and containing a water-degradable or water-swellable binder such as CMC (carboxymethyl cellulose); nonwoven fabrics of rayon fibers or the like having a fiber length of at most 10 mm or at most 7 mm and having been subjected to water-jetting treatment for entangling the fibers, of which the entangled fibers having such a short length of at most 10 mm are, when having received a large amount of water, unentangled and degraded in water; and paper or nonwoven fabrics of rayon or pulp that contains fibrillated rayon, in which the fibrillated rayon serves as a binder.

These sheets are moistened with water or a liquid chemical, and packaged in a package 35. In the invention, however, the folded sheets 20 may be in dry.

The sheet 21 is rectangular to have a short side 21*a* and a long side 21*b*. Each folded sheet 20 is prepared by folding the sheet 21 about fold lines all parallel to the short side 21*a*.

Concretely, the sheet 21 is firstly folded about a first fold line 22 into two to define an upper central portion 23 and a lower central portion 24. Next, the upper central portion 23 is folded upward about a second fold line 25 into two to define a top flap portion 26 upon the upper central portion 23. On the other hand, the lower central portion 24 is folded downward about a third fold line 27 into two to define a bottom flap portion 28 under the lower central portion 24. In other words, the thus-folded sheet 20 is formed into a W-folded configuration.

As set forth above, the folded sheets 20 are arranged so that the odd-numbered sheets (i), (iii), (v) . . . and the even-numbered sheets (ii), (iv), (vi) . . . are alternately interfolded in opposite directions. With that, the folded sheets 20 are neatly stacked in such a manner that the top flap portion 26 of the underlying sheet 20 lies between the lower central portion 24 and the bottom flap portion 28 of the overlying sheet 20, and that the top flap portion 26 of the underlying sheet 20 and the bottom flap portion 28 of the overlying sheet 20 overlap with each other in a predetermined width Lw of overlapping portion of the two sheets, as shown in FIG. 1 and FIG. 2.

When being in wet, the adjacent sheets, i.e., the bottom flap portion 28 of the overlying sheet 20 and the top flap portion 26 of the underlying sheet 20 are kept in airtight contact with each other at overlapping portion thereof via a water film existing therebetween. On the other hand, while being in dry, the bottom flap portion 28 of the overlying sheet 20 and the top flap portion 26 of the underlying sheet 20 are kept in contact with each other at overlapping portion thereof owing to the surface friction of two sheets.

As shown in FIG. 2, the stack of folded sheets is packaged in a package 35. The package 35 may be any of a hard plastic container or a bag of a wrapping sheet such as film. An access opening 36 is formed in the top face of the package 35 such as a container or a bag. Since the stack of folded sheets of the invention is compact and has a reduced width dimension, the package 35 for it may be made of a soft wrapping sheet. Thus packaged, it is preferable for portable application. The opening width W1 in the lateral direction (i.e., the width direction) of the access opening 36 is preferably at most 30 mm. For example, the access opening 36 may be a slit.

As the case may be, the stack of folded sheets of the invention is packaged in a bag made of a soft wrapping sheet and having an access opening, and the thus-packaged stack will be further packaged in a hard container having an access opening.

When the upper-most sheet is withdrawn through the access opening 36, the underlying sheet that overlaps with the upper-most sheet in the width Lw is lifted and drawn to present an upper portion thereof out of the access opening 36.

In order to present the upper portion of the underlying sheet in a readily accessible location above the access opening 36 after the overlying sheet has been withdrawn, the opening width W1 of the access opening 36 must be suitably defined and, in addition, the width Lw of overlapping portion of the overlying and underlying sheets must also be suitably defined. For wet sheets, the width Lw of overlapping portion is preferably 30±20 mm, more preferably 30±10 mm.

If the length L0 which is an unfolded length of the long side 21*b* of the sheet 21, is expressed by L0=2×L1+L2+L3, wherein L1 indicates the width of the upper and lower central portions 23 and 24, L2 indicates the width of the top flap portion 26, and L3 indicates the width of the bottom flap portion 28 as shown in FIG. 3, the dimensions of each folded sheet in the stack of the invention are defined to satisfy L2+L3−Lw=L1, wherein Lw is preferably 30±20 mm as set forth above. It should be noted that the width L2 is substantially one half of the width L1, and the width L3 is substantially similar to the width L1.

In one example of using sheets each having an unfolded length L0 of 200 mm and having a width L1 of 56.5 mm, the sum of L2 and L3 may be 87 mm, and the width Lw may be 30.5 mm (87−56.5=30.5).

In another example of using sheets each having an unfolded length L0 of 190 mm and having a width L1 of 53.5 mm, the sum of L2 and L3 may be 83 mm, and the width Lw may be 29.5 mm (83−53.5=29.5).

In that manner, the ordinary sheets conventionally used in the art may be folded to have such a narrow width of 56.5 mm or 53.5 mm according of the invention, and, in addition, the width of overlapping portion of the overlying and underlying sheets can be 30 mm or so. Accordingly, the stack of folded sheets of the invention can be packaged, for example, in small packages suitable for portable applications.

As set forth above, a stack of folded sheets of the invention can be so designed that relatively large sheets are folded to neatly stack up the resulting, small folded sheets in the manner specifically described herein. In this structure, the width of overlapping portion of the overlying and underlying sheets can be defined appropriately. Accordingly; it is possible to form the stack of folded sheets which can be packaged even in small packages, and in which the underlying sheet is lifted and drawn to present an upper portion thereof in a readily accessible location above the opening when the sheet is withdrawn out of the package.

While the invention has been described in detail and with reference to specific embodiments thereof, it will be apparent to one skilled in the art that various changes and modifications can be made therein without departing from the spirit and scope thereof.

What is claimed is:

1. A stack of sheets comprising a plurality of individually W-folded wet sheets which are stacked in alignment one on top of each other via an overlapping portion having a predetermined width so that an underlying sheet is lifted along with an overlying sheet when the overlying sheet is withdrawn, wherein each sheet is folded about fold lines all parallel to one side of a wet sheet to define two central portions having identical widths, a top flap portion folded upward upon one central portion, and a bottom flap portion folded downward under the other central portion, the W-folded wet sheets are stacked up so that odd-numbered wet sheets and even-numbered wet sheets are alternately arranged to orient a first fold line of each odd-numbered wet sheet in an opposite direction of a first fold line of each even-numbered wet sheet, and that the top flap portion of the underlying wet sheet overlies the bottom flap portion of the overlying wet sheet to define the overlapping portion, and a dimension of each W-folded wet sheet is defined to satisfy L2+L3−Lw=L1, if an unfolded length L0 of each sheet is expressed by L0=2×L1+L2+L3, wherein Lw indicates the width of the overlapping portion, L1 indicates the width of the two central portions, L2 indicates the width of the top flap portion, and L3 indicates the width of the bottom flap portion.

2. A stack of wet sheets comprising a plurality of individually W-folded wet sheets fabricated from water decomposable material and held in a wet condition when contained in a package, said plurality of individually folded wet sheets being stacked in alignment one on top of each other via an overlapping portion having a predetermined width so that an underlying wet sheet is lifted along with an overlying wet sheet when the overlying wet sheet is withdrawn, wherein each wet sheet is folded about fold lines all parallel to one side of the wet sheet to define two central portions having identical widths, a top flap portion folded upward upon one central portion, and a bottom flap portion folded downward under the other central portion, and the folded sheets are stacked up so that odd-numbered sheets and even-numbered sheets are alternately arranged to orient a first fold line of each odd-numbered sheet in an opposite direction of a first fold line of each even-numbered sheet, and that the top flap portion of the underlying sheet overlies the bottom flap portion of the overlying sheet to define the overlapping portion.

3. The stack of sheets as set forth in claim 1 or 2, wherein the sheets are moistened with water or solution, and a width Lw of the overlapping portion is 30±20 mm.

4. The stack of sheets as set forth in claim 3, wherein the dimension of each folded sheet is defined to satisfy L2+L3−Lw=L1, if an unfolded length L0 of each sheet is expressed by L0=2×L1+L2+L3, wherein L1 indicates the width of the central portions, L2 indicates the width of the top flap portion, and L3 indicates the width of the bottom flap portion.

5. The stack of sheets as set forth in claim 1 or 2, which is packaged in a hard or soft package having an access opening in a top face thereof to facilitate a dispensing of the sheets one at a time through the access opening.

6. A stack of sheets comprising a plurality of individually W-folded wet sheets formed from a water decomposable sheet material, which are stacked one on top of each other via an overlapping portion having a predetermined width and nested within a package container such that an underlying sheet is lifted along with an overlying sheet when the overlying sheet is withdrawn, wherein each sheet is folded about fold lines all parallel to one side of the wet sheet to define two central portions having identical widths, a top flap portion folded upward upon one central portion, and a bottom flap portion folded downward under the other central portion, the W-folded wet sheets are stacked up so that odd-numbered wet sheets and even-numbered wet sheets are alternately arranged to orient a first fold line of each odd-numbered wet sheet in an opposite direction of a first fold line of each even-numbered sheet, and that the top flap portion of the underlying wet sheet overlies the bottom flap portion of the overlying wet sheet to define the overlapping portion, and a dimension of each W-folded sheet is defined to satisfy $L2+L3-Lw=L1$, if an unfolded length $L0$ of each sheet is expressed by $L0=2\times L1+L2+L3$, wherein Lw indicates the width of the overlapping portion, $L1$ indicates the width of the two central portions, $L2$ indicates the width of the top flap portion, and $L3$ indicates the width of the bottom flap portion.

7. A stack of sheets comprising a plurality of individually W-folded wet sheets formed from a water decomposable sheet material fabricated by fibers having fiber lengths less than or equal to 10 mm, which are stacked one on top of each other via an overlapping portion having a predetermined width and nested within a package container such that an underlying sheet is lifted along with an overlying sheet when the overlying sheet is withdrawn, wherein each sheet is folded about fold lines all parallel to one side of the wet sheet to define two central portions having identical widths, a top flap portion folded upward upon one central portion, and a bottom flap portion folded downward under the other central portion, the W-folded wet sheets are stacked up so that odd-numbered wet sheets and even-numbered wet sheets are alternately arranged to orient a first fold line of each odd-numbered wet sheet in an opposite direction of a first fold line of each even-numbered sheet, and that the top flap portion of the underlying wet sheet overlies the bottom flap portion of the overlying wet sheet to define the overlapping portion, and a dimension of each W-folded sheet is defined to satisfy $L2+L3-Lw=L1$, if an unfolded length $L0$ of each sheet is expressed by $L0=2\times L1+L2+L3$, wherein Lw indicates the width of the overlapping portion, $L1$ indicates the width of the two central portions, $L2$ indicates the width of the top flap portion, and $L3$ indicates the width of the bottom flap portion.

* * * * *